US009102490B2

(12) United States Patent
Niwa et al.

(10) Patent No.: US 9,102,490 B2
(45) Date of Patent: Aug. 11, 2015

(54) WEB WINDING APPARATUS

(71) Applicant: JTEKT Corporation, Osaka (JP)

(72) Inventors: Naohisa Niwa, Nagoya (JP); Toshiyoshi Ichikawa, Anjo (JP); Norihito Sakakibara, Toyota (JP)

(73) Assignee: JTEKT CORPORATION, Osaka-shi (JP)

( * ) Notice: Subject to any disclaimer, the term of this patent is extended or adjusted under 35 U.S.C. 154(b) by 133 days.

(21) Appl. No.: 13/790,676

(22) Filed: Mar. 8, 2013

(65) Prior Publication Data

US 2013/0248642 A1 Sep. 26, 2013

(30) Foreign Application Priority Data

Mar. 26, 2012 (JP) ..... 2012-069296

(51) Int. Cl.

| | |
|---|---|
| ***B65H 35/08*** | (2006.01) |
| ***B65H 19/26*** | (2006.01) |
| ***B65H 19/28*** | (2006.01) |
| ***B65H 18/08*** | (2006.01) |

(52) U.S. Cl.

CPC ..... *B65H 19/26* (2013.01); *B65H 18/08* (2013.01); *B65H 19/28* (2013.01); *B65H 19/283* (2013.01); *B65H 2301/4132* (2013.01); *B65H 2301/4139* (2013.01); *B65H 2301/5151* (2013.01); *B65H 2301/515323* (2013.01); *B65H 2402/31* (2013.01); *B65H 2402/32* (2013.01); *B65H 2403/942* (2013.01); *B65H 2801/72* (2013.01)

(58) Field of Classification Search

USPC ..... 242/527, 527.1–527.7, 532.2

See application file for complete search history.

(56) References Cited

U.S. PATENT DOCUMENTS

| | | | | |
|---|---|---|---|---|
| 3,157,371 | A | | 11/1964 | Billingsley |
| 3,383,064 | A | | 5/1968 | Daly et al. |
| 3,552,670 | A | * | 1/1971 | Herman ..... 242/527.1 |
| 4,767,075 | A | | 8/1988 | Peters et al. |
| 4,988,052 | A | | 1/1991 | Urban |

(Continued)

FOREIGN PATENT DOCUMENTS

| | | | |
|---|---|---|---|
| EP | 1 306 334 | A2 | 5/2003 |
| EP | 1 306 334 | A3 | 5/2003 |
| EP | 2 062 841 | A1 | 5/2009 |
| GB | 2 136 403 | A | 9/1984 |
| JP | 2807857 | B2 | 7/1998 |
| JP | 3506818 | B2 | 12/2003 |

OTHER PUBLICATIONS

U.S. Appl. No. 13/790,539, filed Mar. 8, 2013, Niwa, et al.

(Continued)

*Primary Examiner* — Sang Kim

(74) *Attorney, Agent, or Firm* — Oblon, McClelland, Maier & Neustadt, L.L.P.

(57) ABSTRACT

A web winding apparatus comprises two bobbins each being able to wind a web thereon; a cutter provided movably between the bobbin on one side and the bobbin on the other side for cutting the web being transferred; and a web pressing member provided at a position to face the cutter so that the web being transferred is put between the web pressing member and the cutter. The web pressing member is provided movably together with the cutter between the two bobbins, is configured to operate as cutter receiving member which presses and cuts the web in cooperation with the cutter, and is further configured to press a cut end of the web so cut on the bobbin being empty while holding the cut end of the web, to wind the cut end on the bobbin being empty.

6 Claims, 9 Drawing Sheets

(56) References Cited

U.S. PATENT DOCUMENTS

| | | | | |
|---|---|---|---|---|
| 5,288,034 | A | 2/1994 | Schonmeier et al. | |
| 5,562,038 | A | 10/1996 | Bierbaum et al. | |
| 7,264,193 | B2 * | 9/2007 | Hikita | 242/527.2 |
| 2003/0080235 | A1 | 5/2003 | Sato et al. | |
| 2008/0223973 | A1 | 9/2008 | Endo et al. | |
| 2009/0242686 | A1 | 10/2009 | Oelen et al. | |

OTHER PUBLICATIONS

U.S. Appl. No. 13/790,232, filed Mar. 8, 2013, Niwa, et al.
Extended European Search Report issued Jan. 8, 2014 in Patent Application No. 13159356.8.

* cited by examiner

WEB WINDING APPARATUS

INCORPORATION BY REFERENCE

This application is based on and claims priority under 35 U.S.C. 119 with respect to Japanese patent application No. 2012-069296 filed on Mar. 26, 2012, the entire content of which is incorporated herein by reference.

BACKGROUND OF THE INVENTION

1. Field of the Invention

The present invention relates to a web winding apparatus for winding a web being transferred to come, on a bobbin.

2. Discussion of the Related Art

Heretofore, as web winding apparatuses, there have been known those described in JP2807857 B (JP7-101604 A) and JP3506818 B (JP9-063565 A). In those apparatuses, a member with two bobbins supported thereon is provided to be turnable, and through the turn of the member, a bobbin filled with winding turns is dismounted therefrom, while a bobbin being empty can wind the web that is transferred to come during that time.

In the apparatus described in JP2807857 B, just before the beginning to wind the web on the empty bobbin, the web is cut by a cutter, and air is blown against the end of the cut web to press the end of the web on the bobbin. However, an anxiety arises in that the air blow is unable to reliably press the end portion of the web on the bobbin.

Further, in the apparatus described in JP3506818 B, after the cutting of the web by a cutter, the end portion of the web has to be transferred to a position where it is wound on the bobbin. This gives rises to an anxiety in that the cut end of the web is folded or loosened.

SUMMARY OF THE INVENTION

It is therefore an object of the present invention to provide a web winding apparatus capable of winding an end portion of a web reliably on a bobbin.

According to the present invention in a first aspect, there is provided a web winding apparatus, which comprises two bobbins each being able to wind a web thereon; a cutter provided movably between the bobbin on one side and the bobbin on the other side for cutting the web being transferred; and a web pressing member provided at a position to face the cutter so that the web being transferred is put between the web pressing member and the cutter, and provided movably together with the cutter between the two bobbins, the web pressing member operating as cutter receiving member which presses and cuts the web in cooperation with the cutter, and also operating to press a cut end of the web so cut on the bobbin being empty while holding the cut end of the web, to wind the cut end of the web on the bobbin being empty.

With this construction in the first aspect, the web pressing member operates as cutter receiving member. As means for cutting the web with the cutter, it may be conceivable to provide means for holding the web with a predetermined tension force applied thereto or means for arranging the cutter receiving member on an opposite side to the cutter side of the both sides of the web. The latter means of using the cutter receiving member is applied to the present invention.

By being operated as the cutter receiving member, the web pressing member is able to hold the cut end of the web just cut with the cutter. Further, the web pressing member also operates to press the web held thereby on the bobbin being empty. That is, because of being able to continue holding the cut end of the web, the web pressing member is able to press the cut end of the web on the empty bobbin while keeping the holding state.

Therefore, the cut end of the web is wound by the web pressing member on the empty bobbin. That is, since the cut end of the web is pressed directly on the empty bobbin not by an air blow but by the web pressing member, it is possible to reliably wind the end portion of the web on the empty bobbin. As a result, the web can be prevented from being folded or loosened at the end portion thereof when wound on the bobbin.

BRIEF DESCRIPTION OF THE ACCOMPANYING DRAWINGS

The foregoing and other objects and many of the attendant advantages of the present invention may readily be appreciated as the same becomes better understood by reference to the preferred embodiment of the present invention when considered in connection with the accompanying drawings, wherein like reference numerals designate the same or corresponding parts throughout several views, and in which.

DETAILED DESCRIPTION OF THE PREFERRED EMBODIMENT (Examples of Objects Handled by Web Winding Apparatus)

For example, in the manufacturing of lithium cells or batteries, a film-like sheet such as aluminum foil or the like is prepared in the form of a roll shape in advance. The manufacturing includes steps of unwinding the sheet from an unwinding device, subjecting the sheet to a coating treatment, and after drying, winding the sheet again in the roll shape. At one of the manufacturing steps, a web winding apparatus in the present embodiment is used as the device for winding the sheet in the form of a roll shape. That is, the web winding apparatus winds in the form of a roll shape the web that is transferred to come thereto after the coating and drying. Particularly, the web winding apparatus in the present embodiment is an apparatus capable of winding the web transferred thereto without being provided with a device for storing the web and without stopping the transferring of the web. It is to be noted that although the web winding apparatus in the present embodiment will be described by exemplifying the manufacturing for lithium batteries, it is applicable to any other apparatuses that are designed to wind a web in the form of a roll shape.

(Exterior Construction of Web Winding Apparatus)

Figure 1:
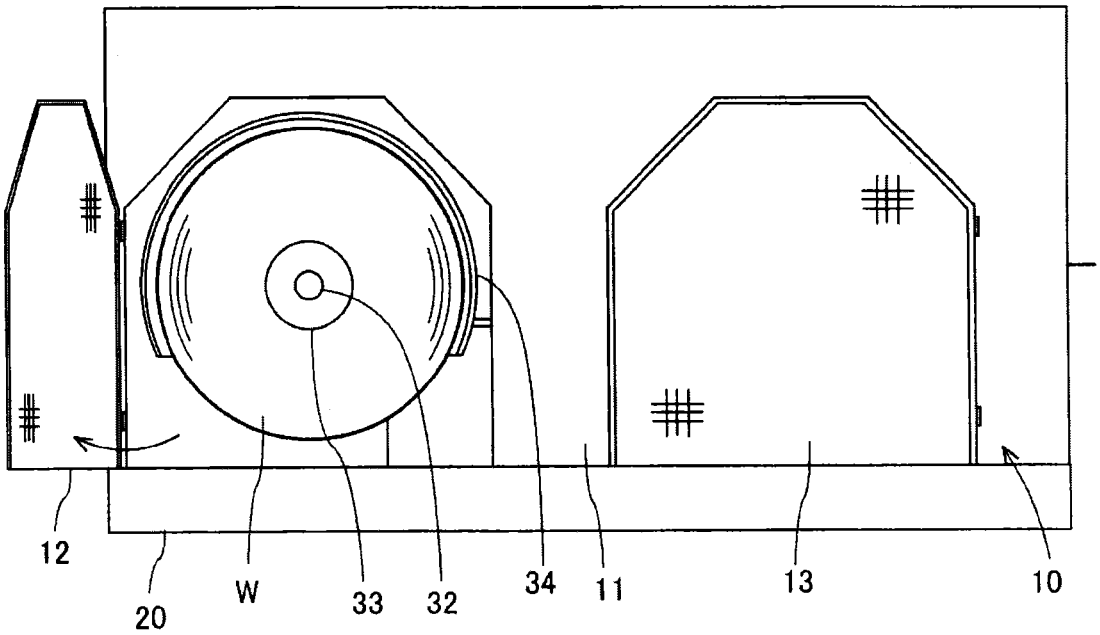
FIG. 1 is a front exterior view of a web winding apparatus in the state that an opening/closing cover on the left side has been opened.
Figure 2:
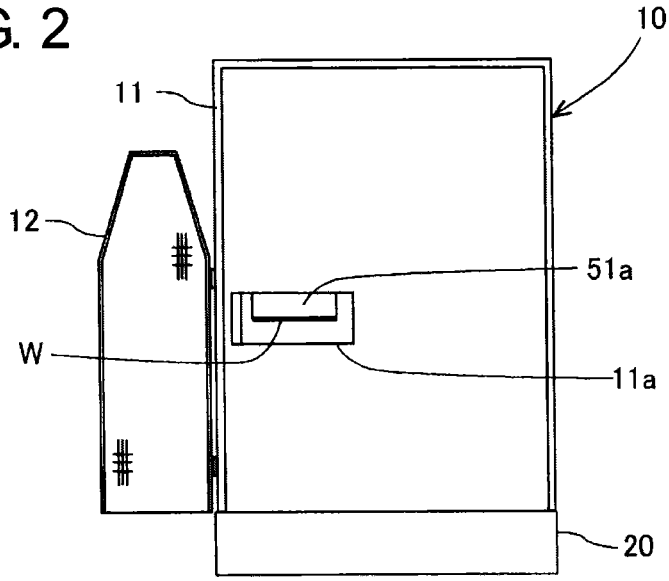
FIG. 2 is a right side view of the web winding apparatus in FIG. 1.

The exterior construction of the web winding apparatus in the present embodiment will be described with reference to FIGS. 1 and 2. As shown in FIGS. 1 and 2, the web winding apparatus is surrounded by an overall cover 10. The overall cover 10 is provided with a fixed cover 11 fixed to a bed (base) 20 and two opening/closing covers 12, 13, each capable of being opened and closed, respectively at left and right on the front side of the fixed cover 11. Each of the opening/closing covers 12, 13 is opened when a web W having been wound in the form of a roll shape is taken out, and remains closed while the web is being wound. FIGS. 1 and 2 show the opening/closing cover 12 on the left side in an open state and the opening/closing cover 13 on the right side in a closed state.

Further, the web is transferred to come from the right side in FIG. 1. Thus, as show in FIG. 2, an opening window 11*a* is formed on a right side surface of the fixed cover 11 in order to take inside the web being transferred to come.

(Interior Construction of Web Winding Apparatus)

Next, the interior construction of the web winding apparatus will be described with reference to FIGS. 3 to 7 in which the overall cover 10 is omitted for better understanding. The web winding apparatus is provided with a first web support device 30, a second web support device 40, a transfer device 50 and a cutting and joining device 60.

The first and second web support devices 30, 40 are provided with support bodies 31, 41 (frames), rotational center members 32, 42, bobbins 33, 43 and outer peripheral covers 34, 44, respectively. The support bodies 31, 41 stand upright on the bed 20 on left and right sides of the bed 20 as viewed from the front side. The support bodies 31, 41 may be fixed on the bed 20 or may be provided on the bed 20 movably in a front-rear direction (the direction normal to the drawing sheet of FIG. 3).

The rotational center members 32, 42 are provided to protrude from front vertical walls of the respective support bodies 31, 41 rotatably about respective axes that extend in the front-rear direction in parallel to each other. The rotational center members 32, 42 rotate about the respective axes in the same direction (i.e., clockwise as viewed in FIG. 3). The respective bobbins 33, 43 are detachably supported on the respective rotational center members 32, 42 and each operate to wind thereon the web W transferred to come thereto. That is, since the bobbins 33, 43 rotates about the respective center axes in the same direction (clockwise in FIG. 3), the directions in which the bobbins 33, 43 wind the web W become the same clockwise in FIG. 3. Further, a double-sided adhesive tape or adhesive agent is applied to a part on each of the bobbins 33, 43 for adhering an end portion of the web W thereto.

The outer peripheral covers 34, 44 are provided on the respective support bodies 31, 41 and are pivotable in both directions about the rotational center members 32, 42 independently of the same, respectively. The outer peripheral covers 34, 44 cover up parts of the webs W wound respectively on the bobbins 33, 43 and have openings in the circumferential direction thereof. That is, the outer peripheral covers 34, 44 take the form of a C-letter. Through pivot movements, the outer peripheral covers 34, 44 are movable to the positions where the circumferential openings face each other and to the positions where the circumferential openings face the bed 20 side (are directed downward in FIG. 3). Further, the outer peripheral covers 34, 44 are formed to have the external shape which is smaller slightly in dimension than the interior shape of the opening/closing covers 12, 13, as illustrated in FIG. 1.

The transfer device 50 is provided with a first transfer-roller support pedestal 51, a second transfer-roller support pedestal 52, and transfer rollers 51*a*, 51*b*, 52*a*-52*c* that transfer the web W. The first transfer-roller support pedestal 51 stands upright on the bed 20 at the right end thereof and rotatably supports the transfer rollers 51*a*, 51*b* respectively at a center portion and an upper end portion thereof in the vertical direction. The second transfer-roller support pedestal 52 stands upright on the bed 20 at a center portion in the left-right direction and rotatably supports the transfer rollers 52*a*-52*c* at an upper end portion thereof in the vertical direction.

The web W transferred to come from outside is transferred to travel on the rollers 51*a*, 51*b*, 52*a*, 52*b* and 52*c* in turn. These transfer rollers 51*a*, 51*b*, 52*a*-52*c* are freely rotatable. In particular, the transfer roller 52*b* is supported by a mechanism having a tension adjusting function and is movable slightly relative to the second transfer-roller support pedestal 52. Although the transfer rollers 51*a*, 51*b*, 52*a*-52*c* are designed as freely rotatable rollers, there may be provided one or more rotational driving sources therefor.

The cutting and joining device 60 is arranged at a center portion between the first and second web support devices 30, 40 in the left-right direction and transfers to one of the bobbins 33, 43 the web W which is transferred by the transfer device 50 from outside to the center portion between the first and second web support devices 30, 40 in the left-right direction. Further, when winding turns are filled up on one of the bobbins 33, 43, the cutting and joining device 60 cuts the web W and winds a cut end of the web W on the other of the bobbins 33, 43.

The cutting and joining device 60 is provided with a guide base 61, a slide head 62, a pivot plate 63, a lead roller 64, a cutter unit 65 and a web pressing unit 66. The guide base 61 is provided on the bed 20 at a center portion between the support bodies 31, 41 in the left-right direction and has rails 61*a* extending in the left-right direction, on an upper surface thereof. The guide base 61 is arranged on the front side of the second transfer-roller support pedestal 52.

The slide head 62 is provided on the upper surface of the guide base 61 slidably along the rails 61*a* in the left-right direction. That is, the slide head 62 is slidable between the bobbin 33 on one side and the bobbin 43 on the other side. The pivot plate 63 is provided at a front, vertical wall surface of the slide head 62 pivotably in both directions about an axis extending in the front-rear direction. The lead roller 64 is provided at the front surface of the pivot plate 63 freely rotatably about an axis extending in the front-rear direction. The lead roller 64 is a roller that receives the web W transferred from the transfer roller 52*c* and transfers the web W toward the bobbins 33, 43.

The cutter unit 65 is supported by the pivot plate 63 and is able to be drivingly turned relative to the pivot plate 63 in the same direction as the rotational direction of the bobbins 33, 43. That is, the cutter unit 65 is movable between the bobbin 33 on one side and the bobbin 43 on the other side. The turn center of the cutter unit 65 is set to be offset from the rotational center of the lead roller 64 as viewed in FIG. 3. The cutter unit 65 is provided with a cutter member 65*a* and first and second rollers 65*b*, 65*c*.

Figure 6:
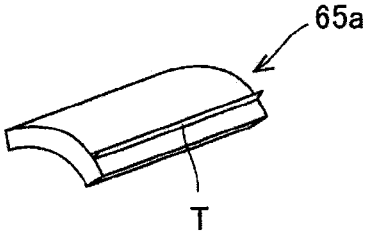
FIG. 6 is an enlarged perspective view of a cutter member shown in FIG. 3.

As shown in FIG. 6, the cutter member 65*a* has a circular arc convex surface at a radially outside thereof. The circular arc convex surface of the cutter member 65*a* is formed to a circular arc surface centered at the axis for the clockwise turn of the cutter unit 65. The cutter member 65*a* has a cutter T for cutting the web W, at one end portion in the circumferential direction of the circular arc (that is, on an advanced end side in the turn direction). The cutter T is wider in width than the web W. The first and second rollers 65*b*, 65*c* are provided on the back side of the cutter member 65*a* and are freely rotatable.

The web pressing unit 66 is supported by the pivot plate 63 and is able to be drivingly turned relative to the pivot plate 63 in an opposite direction (counterclockwise as viewed in FIG. 3) to the rotational direction of the bobbins 33, 43. That is, the web pressing unit 66 moves together with the cutter unit 65 between the bobbin 33 on one side and the bobbin 43 on the other side. The turn center of the web pressing unit 66 is set to be offset from the rotational center of the lead roller 64 and the turn center of the cutter unit 65, as viewed in FIG. 3. Further, the web pressing unit 66 is provided at a position where it faces the cutter unit 65 so as to put the web W transferred from the lead roller 64 between itself and the cutter unit 65.

Figure 7:
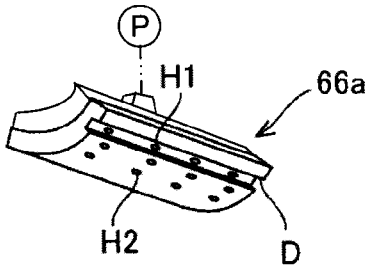
FIG. 7 is an enlarged perspective view of a web pressing member shown in FIG. 3.

The web pressing unit 66 is provided with a web pressing member 66*a* and first and second rollers 66*b*, 66*c*. As shown in FIG. 7, the web pressing member 66*a* has a circular arc convex surface at the radial outside thereof. The circular arc convex surface of the web pressing member 66*a* is formed to a circular arc convex surface centered at the center for the counterclockwise turn of the web pressing unit 66. The web pressing member 66*a* has a groove D that serves as surface to receive the cutter T, around at one end portion in the circumferential direction of the circular arc (i.e., on an advanced end side of the turn direction). In other words, the web pressing member 66*a* operates as cutter receiving surface.

Further, the circular arc convex surface of the web pressing member 66*a* is formed to be located to contact the circular arc convex surface of the cutter member 65*a* or to have such a slight clearance as to be able to grip the web relative to the circular arc convex surface of the cutter member 65*a*. That is, the web pressing member 66*a* operates to press the web W in cooperation with the cutter member 65*a* so that the web W can be cut by the cutter T. Further, the web pressing member 66*a* is formed to be located to contact the lead roller 64 or to have such a slight clearance as to be able to grip the web relative to the lead roller 64.

Further, as shown in FIG. 7, the web pressing member 66*a* has pluralities of pump suction holes H1, H2 respectively at the groove D and the circular arc convex surface. These pump suction holes H1, H2 are in fluidal communication with a common vacuum pump P, as schematically illustrated in FIG. 7. The pump suction holes H1 at the groove D draws dust that is produced at the time of cutting the web W, by the drawing force (vacuum force) of the pump P (dust drawing means). Further, the pump suction holes H2 at the circular arc convex surface draws and holds the cut end of the web W so cut, by the drawing force of the pump P (holding means). Of course, the suction holes H1 at the groove D also operate to hold the cut end of the web W in addition to the dust drawing operation. The downsizing can be realized by using the common pump P for the dust drawing and for the holding of the web W. Further, by using the drawing force of the pump P for the both means, the web pressing member 66*a* becomes simple in construction.

Besides the drawing force by the pump P, there may be used a drawing force by static electricity or a drawing force by magnetic force for the function of holding the cut end of the web W. Where static electricity is employed, it is preferable for example to use a low-conductivity material such as resin, ceramics or the like for the cutter member 65*a* and to use a high-conductivity material such as metal or the like for the web pressing member 66*a*.

Further, the web pressing member 66*a* presses the circular arc convex surface on the bobbin 33/43 being empty in the state that it continues holding the cut end of the web W. As a consequence, the cut end of the web W is pressed on the empty bobbin 33/43, so that there begins a winding of the cut end of the web W on the empty bobbin 33/43.

The first and second roller 66*b*, 66*c* of the web pressing unit 66 are provided on the back side of the web pressing member 66*a* and are freely rotatable. The second roller 66*c* operates as touch roller so that during the winding of the web W on the bobbin 33/43, the web W transferred from the lead roller 64 to the bobbin 33/43 side is wound always at a fixed angle relative to the outer peripheral surface of the bobbin 33/43 and the outer peripheral surface of the wound web W.

The lead roller 64, the cutter unit 65 and the web pressing unit 66 are rotatably supported by the pivot plate 63. Therefore, by pivoting the pivot plate 63 in both directions, there occurs a state that the web pressing unit 66 is rocked when viewed with the cutter unit 65 taken as reference.

(Web Winding Operation in Web Winding Apparatus)

Figure 3:
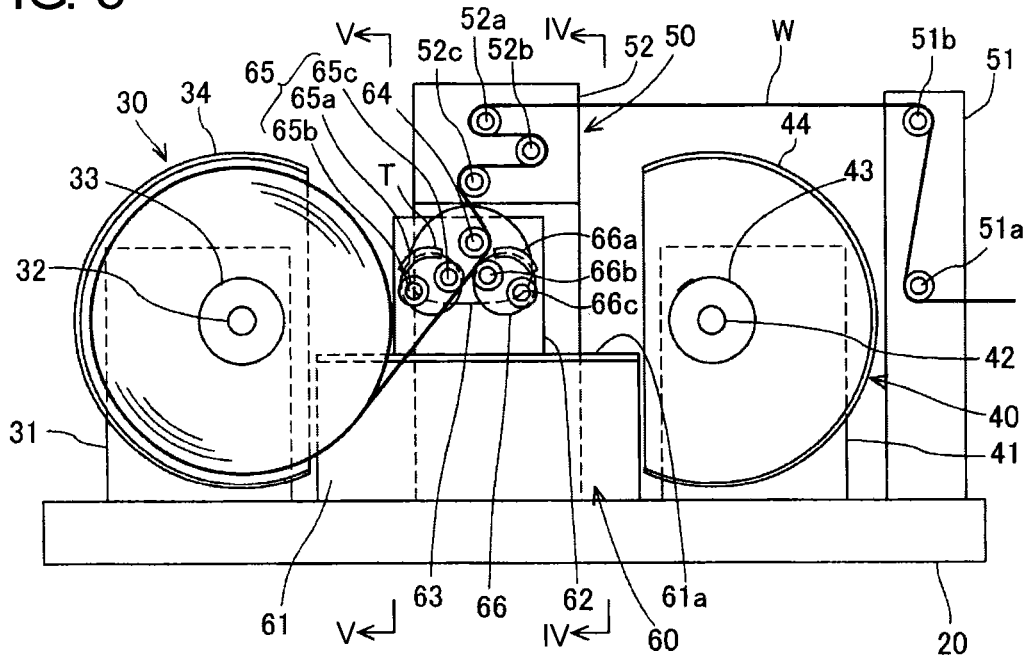
FIG. 3 is a front view of the web winding apparatus shown in FIG. 1 with an outer frame cover having been removed.

Next, the operation of the web winding apparatus will be described with reference to FIGS. 3 and 8 to 21. It is to be noted that FIGS. 8 to 10 and 12 to 21 only illustrate parts of the construction. The state show in FIG. 3 is supposed as initial state. The web winding apparatus involves an operation to start the winding of the web W on the bobbin 33/43 being empty and to bring the bobbin 33/43 into a filled-up state of the web W (web winding operation) and another operation to dismount the bobbin 33/43 filled with winding turns (bobbin dismounting operation). For ease in description, the web winding operation will be described first, and the bobbin dismounting operation will be described then.

(Web Winding Operation in Web Winding Apparatus)

In the state shown in FIG. 3, the left bobbin 33 is winding the web W and is just before the winding completion. At this time, the slide head 62 is almost at the center between the bobbins 33, 43. Further, the peripheral covers 34, 44 have been positioned to make the circumferential openings thereof face each other, that is, to direct the circumferential openings thereof toward the lead roller 64.

Figure 8:
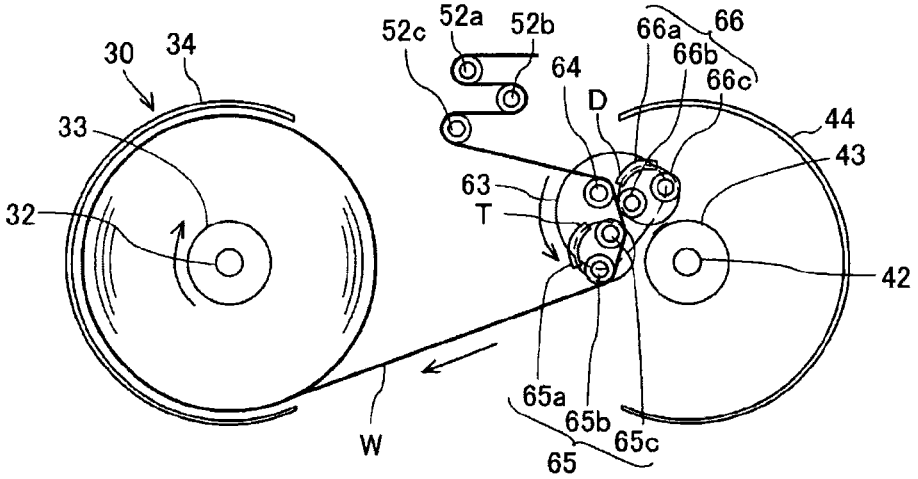
FIG. 8 is an illustration showing the state that upon completion of the winding on a left bobbin, a web cutting and joining device has been moved to a right bobbin side.

From this initial state, the operation is started to cut the web W without stopping the transfer of the web W and to wind the cut end portion of the web W on the right bobbin 43 being empty. First of all, from the initial state, the pivot plate 63 is pivoted counterclockwise to reach a set phase and directs the cutter unit 65 and the web pressing unit 66 toward the right bobbin 43 side, as shown in FIG. 8. Further, the slide head 62 is moved toward the right bobbin 43 side to make the cutter unit 65 and the web pressing unit 66 come close to the right bobbin 43. At this time, the lead roller 64 and the first and second rollers 65*b*, 65*c* of the cutter unit 65 transfer the web W toward the bobbin 33 side.

In this state, because the right bobbin 43 rotates clockwise, the web pressing member 66*a* in winding the end portion of the web W on the right bobbin 43 is located at the advanced side in the rotational phase of the right bobbin 43 relative to the cutter T of the cutter member 65*a*.

Figure 9:
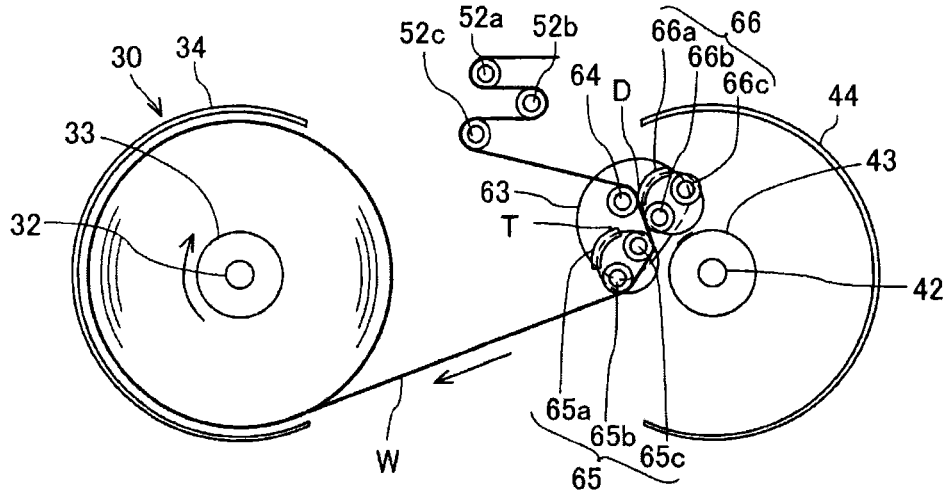
FIG. 9 is an illustration showing the state subsequent to the state shown in FIG. 8 and the state just before the cutting of the web.

Then, as shown in FIG. 9, in the state that the pivot plate 63 is positioned, the cutter unit 65 and the web pressing unit 66 are synchronously turned in mutually opposite directions. This brings about the state that the circular arc convex surface of the web pressing member 66*a* and the lead roller 64 hold the web W therebetween.

Figure 10:
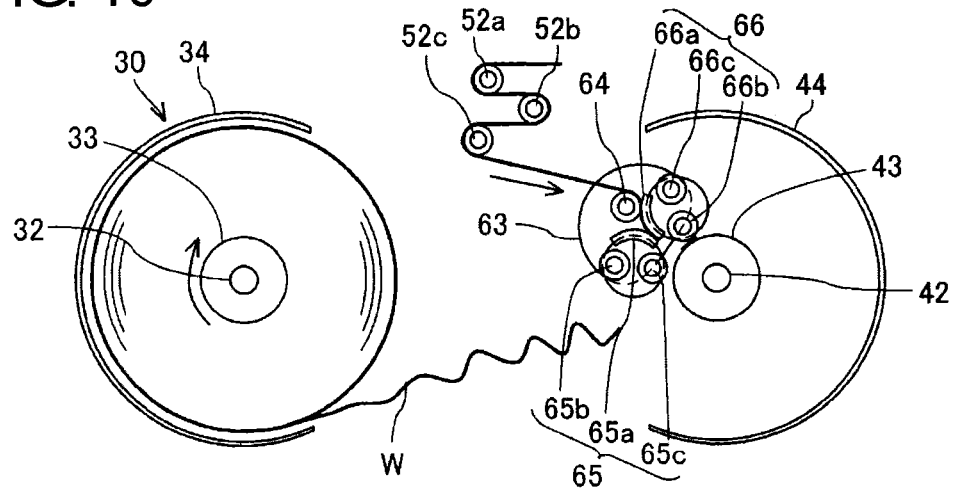
FIG. 10 is an illustration showing the state subsequent to the state shown in FIG. 9 and the state being at the time of cutting the web.

Then, as shown in FIG. 10, the cutter unit 65 and the web pressing unit 66 are synchronously turned further in the mutually opposite directions. Thus, the web W is pressed between the circular arc convex surface of the cutter member 65*a* and the circular arc convex surface of the web pressing member 66*a* to be held on the web pressing member 66*a*. At this time, as shown FIGS. 10 and 11, the cutter T on the cutter member 65*a* enters the groove D on the web pressing member 66*a* to cut the web W existing therebetween. As a result, the cut end of the web W so cut is held by the cutter member 65*a* and the web pressing member 66*a*.

At this time, the vacuum pump P being in fluid communication with the web pressing member 66*a* is driven to draw dust produced at the time of cutting the web W, through the pump suction holes H1 at the groove D on the web pressing member 66*a*. At the same time, the drawing vacuum force through the pump suction holes H2 at the circular arc convex surface of the web pressing member 66*a* acts to draw and hold the end portion including the cut end of the web W so cut. By operating the web pressing member 66*a* to act as cutter receiving member and to hold the web W, the web pressing member 66*a* can reliably hold the cut end of the web W.

Figure 12:
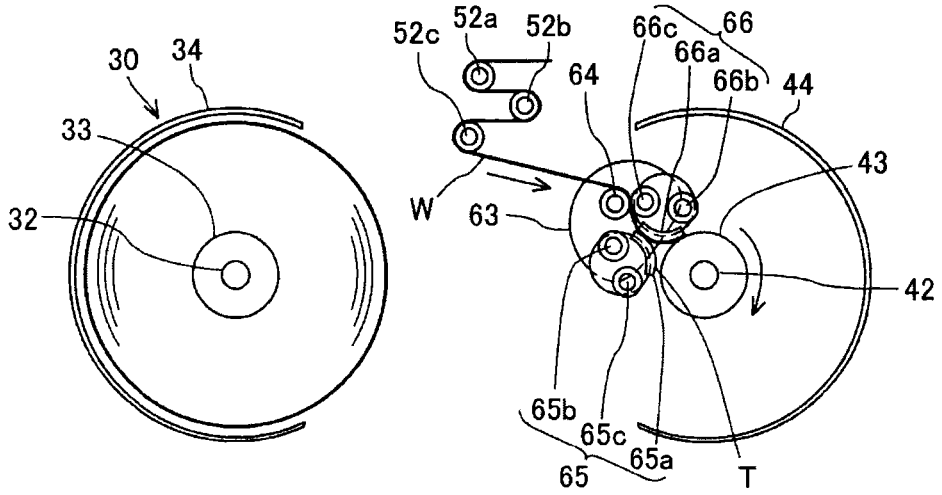
FIG. 12 is an illustration showing the state subsequent to the state shown in FIG. 10 and the state that the web pressing member presses a cut end of the web on the right bobbin.

Then, as shown in FIG. 12, the cutter unit 65 and the web pressing unit 66 are synchronously turned further in the mutually opposite directions, and the right bobbin 43 is rotated synchronously with the turn of the web pressing unit 66 in the opposite direction thereto. This causes the web pressing member 66*a* to press the cut end of the web W on the right bobbin 43 being empty. Since at this time, the double-sided adhesive tape or adhesive on the right bobbin 43 is at the position facing the web pressing member 66*a*, the cut end of the web W begins to be wound on the right bobbin 43.

As mentioned above, the web pressing member 66*a* has the function of holding the cut end of the web W and the function of pressing the web W on the right bobbin 43 being empty. Accordingly, the web pressing member 66*a* is able to directly press the cut end of the web W on the right bobbin 43 as it keeps the state of holding the cut end of the web W. Thus, the cut end of the web W can reliably be wound by the web pressing member 66*a* on the right bobbin 43. As a result, the end portion (including the cut end) of the web W can be prevented from being folded or loosened when wound on the right bobbin 43.

Particularly, by synchronously turning the cutter member 65*a* and the web pressing member 66*a*, it becomes possible to shorten the distance from the turn position of the cut end of the web W on the web pressing member 66*a* when the web W is cut, to the turn position of the cut end of the web W on the web pressing member 66*a* when the cut end of the web W begins to be wound on the right bobbin 43. Accordingly, it is possible to prevent the cut end of the web W from separating from the web pressing member 66*a* before being wound on the right bobbin 43. That is, it is possible to reliably wind the cut end of the web W on the right bobbin 43.

Figure 13:
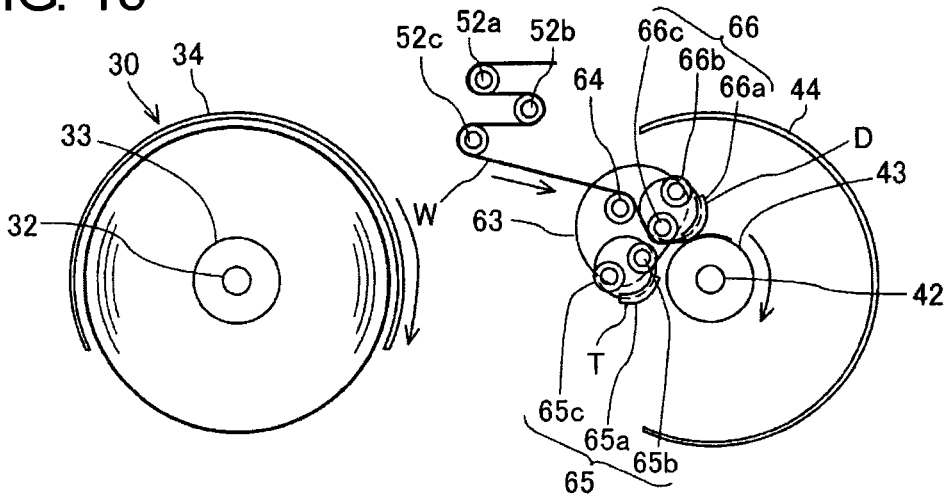
FIG. 13 is an illustration showing the state subsequent to the state shown in FIG. 12 and the state that the web pressing member completes the pressing of an end portion of the web on the right bobbin, and simultaneously showing the state that the left bobbin is ready for dismounting.

Then, as shown in FIG. 13, the cutter unit 65 and the web pressing unit 66 are synchronously turned further in the mutually opposite directions, whereby the web pressing member 66*a* terminates pressing the end portion of the web W on the right bobbin 43.

Figure 14:
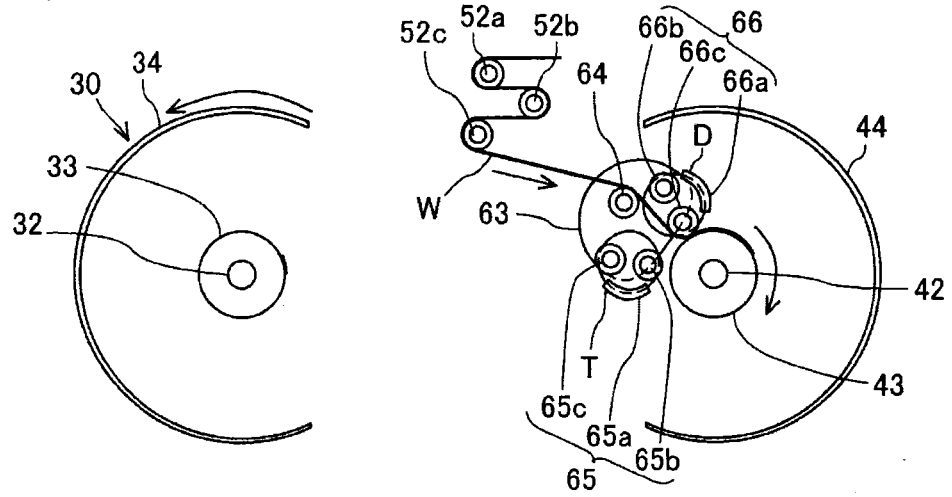
FIG. 14 is an illustration showing the state subsequent to the state shown in FIG. 13 and the state that a touch roller begins the pressing on a winding portion.

Then, as shown in FIG. 14, the cutter unit 65 and the web pressing unit 66 are synchronously turned further in the mutually opposite directions, the turns of the both units 65,66 are stopped at such a position that the second roller 66*c* of the web pressing unit 66 presses the outer peripheral surface of the right bobbin 43. While the web W is wound on the right bobbin 43, the second roller 66*c* remains pressing the outer peripheral surface of the wound web W.

In this way, the second roller 66*c* operates as touch roller that presses the outer peripheral surface of the wound web W. That is, from right after the turn of the web pressing member 66*a*, the second roller 66*c* acts to press the outer peripheral surface of the web W. Accordingly, the winding of the web W on the right bobbin 43 is carried out stably. For example, it can be prevented to involve the air or the like.

Figure 15:
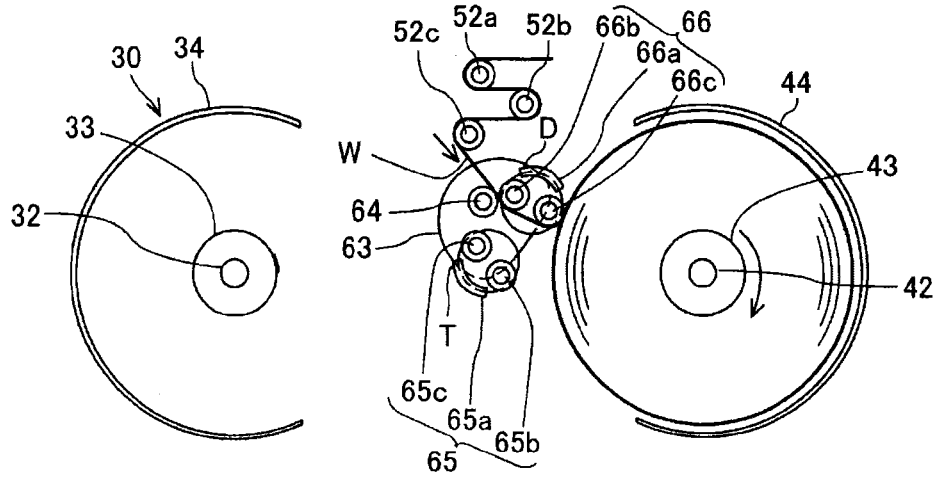
FIG. 15 is an illustration showing the state subsequent to the state shown in FIG. 14 and the state being at the time of completing the winding of the web on the right bobbin.

As the transfer of the web W is continued, the right bobbin 43 becomes filled with winding turns of the web W, as shown in FIG. 15. During this time, the second roller 66*c* remains pressed on the outer peripheral surface of the web W being wound on the right bobbin 43, and the slide head 62 is move toward left to retract the pivot plate, that is, the second roller 66*c* from the right bobbin 43 synchronously with an increase in diameter of the web W wound on the right bobbin 43 (i.e., with an increase in the number of rotations of the right bobbin 43).

Figure 16:
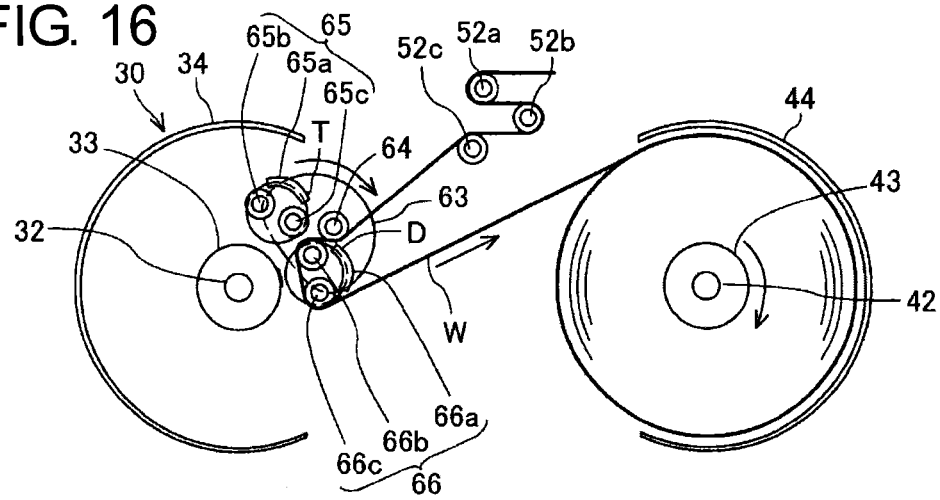
FIG. 16 is an illustration showing the state subsequent to the state shown in FIG. 15 and the state that upon completion of the winding on the right bobbin, the web cutting and joining device has been moved to the left bobbin side.
Figure 17:
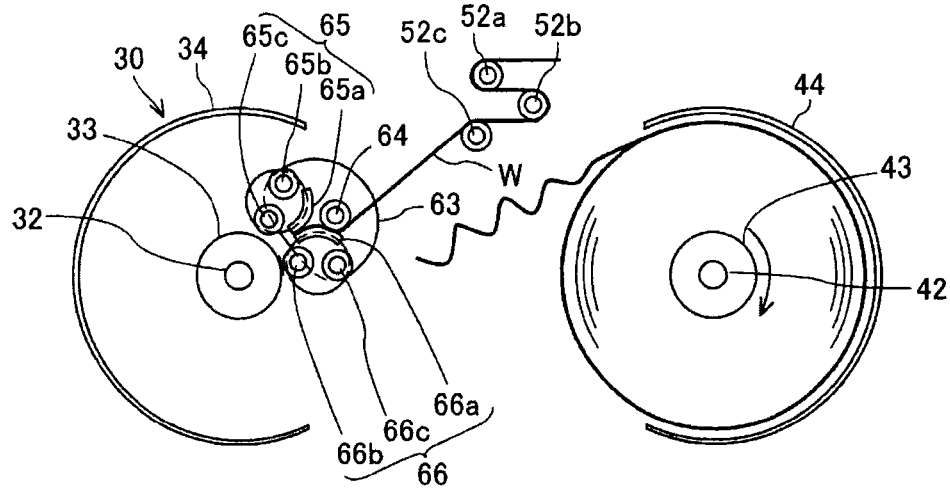
FIG. 17 is an illustration showing the state subsequent to the state shown in FIG. 16 and the state being at the time of cutting the web.
Figure 18:
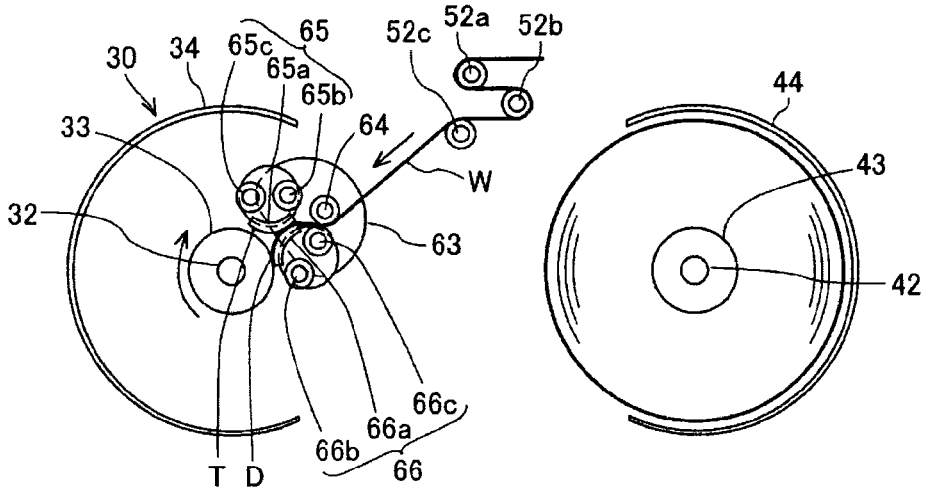
FIG. 18 is an illustration showing the state subsequent to the state shown in FIG. 17 and the state that the web pressing member presses a cut end of the web on the left bobbin.
Figure 19:
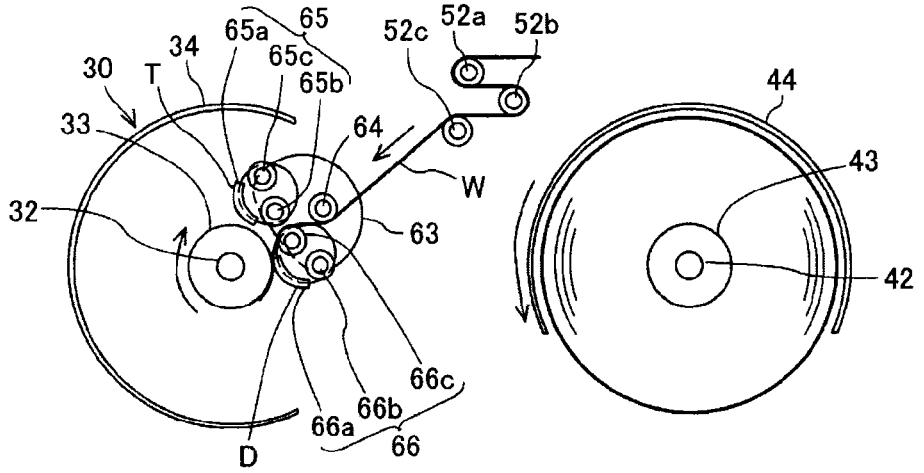
FIG. 19 is an illustration showing the state subsequent to the state shown in FIG. 18 and the state that the web pressing member completes the pressing of the web end portion on the left bobbin, and simultaneously showing the state that the right bobbin is ready for dismounting.
Figure 20:
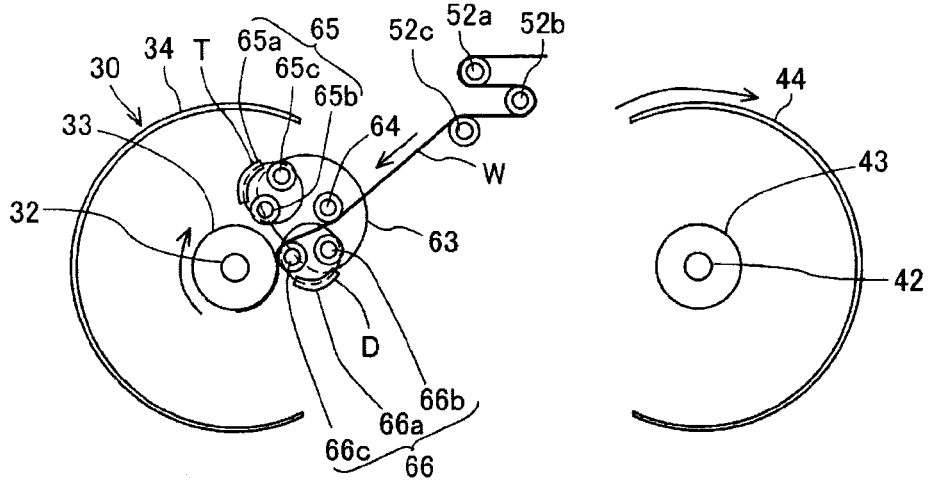
FIG. 20 is an illustration showing the state subsequent to the state shown in FIG. 19 and the state that another touch roller begins the pressing on a winding portion.
Figure 21:
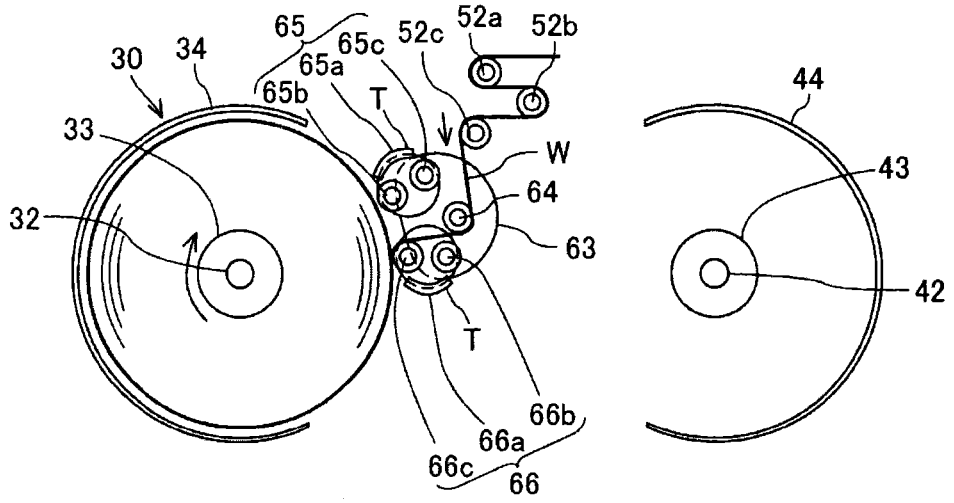
FIG. 21 is an illustration showing the state subsequent to the state shown in FIG. 20 and the state being at the time of completing the winding of the web on the left bobbin.

Then, as shown in FIG. 16, the slide head 62 is moved toward the left bobbin 33 side to the position where the pivot plate 63 is pivotable, and the pivot plate 63 is pivoted clockwise to take another phase. Then, the cutter unit 65 and the web pressing unit 66 are directed toward the left bobbin 33 being empty. Further, the slide head 62 is moved toward the left bobbin 33 side to make the cutter unit 65 and the web pressing unit 66 come close to the left bobbin 33.

Thereafter, the same operations as done with the right bobbin 43 are carried out in turn with the left bobbin 33, as shown in FIGS. 17 to 21. Since like the right bobbin 43, the left bobbin 33 is rotated also clockwise, the web pressing member 66*a* in winding the end portion of the web W on the left bobbin 33 is located at the advanced side in the rotational phase of the left bobbin 43 relative to the cutter T of the cutter member 65*a*.

By doing so, it can be realized that the inside and outside of the web W wound on the left bobbin 43 come to agree with those of the web W wound on the right bobbin 33 in the radial direction. Further, by so providing the web pressing member 66*a* as to be able to rock relative to the cutter T of the cutter member 65*a* through the pivot movement of the pivot plate 63, it is possible as mentioned above to make the inside and outside of the web W wound on the left bobbin 33 come to agree with those of the web W wound on the right bobbin 43 in the radial direction even though each of the cutter T and the web pressing member 66*a* is provided by one only. As a result, the web winding apparatus can be downsized.

(Web Dismounting Operation in Web Winding Apparatus)

Next, the web dismounting operation in the web winding apparatus will be described with reference to FIGS. 1, 12 to 14 and 18 to 20. In the state shown in FIG. 12, the web W having been transferred to the left bobbin 33 has an end cut already. In this state, as shown in FIG. 13, the peripheral cover 34 on the left side is turned clockwise to direct the circumferential opening of the peripheral cover 34 toward the bed 20 side (downward).

Thus, the peripheral cover 34 stands in position to partition the left bobbin 33 side and the lead roller 64 side (corresponding to the side where the cutter unit 65 and the web pressing unit 66 stand). At this time, the periphery cover 34 also stands in position to partition the left bobbin 33 side and the side where the transfer rollers 51*a*, 51*b*, 52*a*-52*c* stand.

After the positioning of the peripheral cover 34 as shown in FIG. 13, the opening/closing cover 12 on the left side is opened as shown in FIG. 1. Then, the operator dismounts the left bobbin 33 filled with winding turns of the web W thereon from the rotational center member 32. During this time, the web W is being wound on the right bobbin 43, and the opening/closing cover 13 on the right side remains closed.

Because the lead roller 64, the cutter unit 65 and the web pressing unit 66 can be evacuated to the right side through the sliding movement of the slide head 62, it becomes possible to dismount the left bobbin 33 from the rotational center member 32 without moving the center of the left bobbin 33. Accordingly, the dismounting of the filled-up bobbin 33 can be realized by the simplified construction.

The peripheral cover 34 is configured to have the circumferential opening. Thus, in winding the web W on the bobbin 33 as mentioned above, the web W is enabled to pass through the circumferential opening of the peripheral cover 34. Therefore, the peripheral cover 34 does not constitute any obstacle in the winding of the web W on the bobbin 33.

In dismounting the left bobbin 33 from the rotational center member 32, on the other hand, the peripheral cover 34 is turned, whereby the peripheral cover 34 acts to partition the bobbin 33 side and the side where the lead roller 64 and the web W being transferred are located. Accordingly, the operator can safely dismount the bobbin 33 from the rotational center member 32. In particular, the degree of safety can be increased by designing the shape of the opening of the opening/closing cover 12 to that resembled closely to the outer shape of the peripheral cover 34.

At the time of dismounting the left bobbin 33, the right opening/closing cover 13 remains covering the position in the axial direction of the right bobbin 43 on which the web W is being wound. Therefore, the operator is prevented by the fixed cover 11, the right opening/closing cover 13 ad the left peripheral cover 34 from touching the web W being transferred onto the right bobbin 43.

After the bobbin 33 filled with winding turns of the web W thereon is dismounted from the rotational center member 32, another empty bobbin 33 is mounted on the rotational center member 32. Then, as shown in FIG. 14, the peripheral cover 34 is turned counterclockwise to direct the circumferential opening of the peripheral cover 34 toward the right bobbin 43 side.

After the bobbin 43 becomes filled with winding turns of the web W, there are carried out operations that are substantially the same as those carried out with the left bobbin 33. Also at this time, the operator can safely dismount the right bobbin 43 from the rotational center member 42.

(Driving Mechanisms and Control Configuration Therefor)

Figure 22:
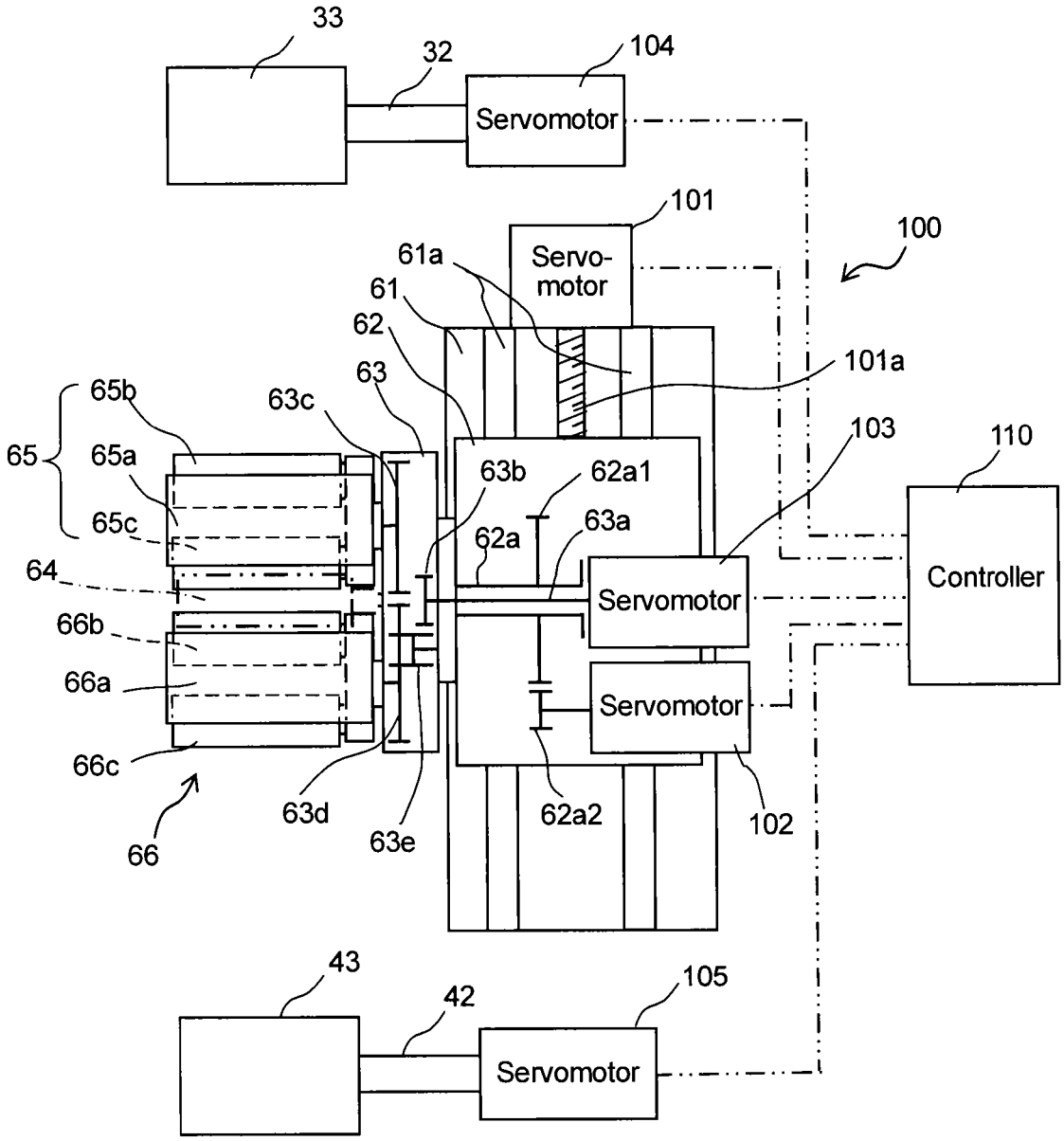
FIG. 22 is a skeletal illustration of drive mechanisms combined with a block diagram of a control system in the web winding apparatus.

FIG. 22 is a schematic illustration of driving mechanisms which are incorporated in the web winding apparatus in the present embodiment and also shows a block diagram of a control system 100 for the driving mechanisms. The slide head 62 slidably guided on the slide base 61 is moved by a head sliding servomotor 101 through a ball screw mechanism 101*a* (corresponding to the sliding mechanism in the claimed invention). The slide head 62 pivotably and coaxially supports a tubular outer shaft 62*a* fixing the pivot plate 63 at a front end thereof, and an inner shaft 63*a* rotatable in the tubular outer shaft 62*a* independently of the same. The tubular outer shaft 62*a* is provided thereon with a driven gear 62*a*1, which is in mesh with a pinion 62*a*2 on an output shaft of a plate rocking servomotor 102, so that the pivot plate 63 is able to rock by the oscillation operation of the plate rocking servomotor 102, as described before. The inner shaft 63*a* is driven by a unit turning servomotor 103 attached to a rear end of the tubular outer shaft 62*a*, and a pinion 63*b* fixed on a front end of the inner shaft 63*a* is housed in the pivot plate 63.

In the interior of the pivot plate 63, driven gears 63*c*, 63*d* which are turnable respectively together with the cutter unit 65 and the web pressing unit 66 are in mesh with each other to turn in opposite directions, so that the cutter unit 65 and the web pressing unit 66 are synchronously turned in the opposite directions as shown in FIGS. 9 to 15, for example. Also in the interior of the pivot plate 63, there is provided an elongated idle pinion 63*e*, which is in mesh with the pinion 63*b* on the inner shaft 63*a* as well as with the driven gear 63*d* turnable together with the web pressing unit 66. Thus, the turns of the cutter unit 65 and the web pressing unit 66 in the opposite directions are synchronously given by the unit turning servomotor 103 through the inner shaft 63*a*, the pinion 63*b*, the elongated idle pinion 63*e* and the driven gears 63*d*, 63*c*.

The servomotors 101 to 103 are electrically connected to a controller 110, to which bobbin driving servomotors 104, 105 are also electrically connected. As the controller 110, there is used a numerical controller known in the art or any other digital controller such as, for example, a programmable logic controller. Thus, it is possible to program controlled operations of the servomotors 101 to 105, so that the aforementioned operations of the web winding apparatus in the present embodiment can be performed in accordance with a control program inputted into the controller 110.

For example, the movement of the pivot plate 63 from the position adjacent to the right bobbin 43 shown in FIG. 15 to the position adjacent to the left bobbin 33 shown in FIG. 16 is given by the slide head 62 moved by the operation of the servomotor 101. Further, the retraction movement of the pivot plate 63 from either one of the bobbins 43, 33 with an increase in the outer diameter (winding turns) of the web W wound on the bobbin 43/33 is given by the synchronous operations of the servomotor 101 and the servomotor 105/104. Further, the pivot movement of the pivot plate 63 between the positions to face the bobbins 43, 33 as shown in FIGS. 9 and 16 is controllable by the operation of the servomotor 102, and the synchronous turns of the cutter unit 65 and the web pressing unit 66 are given by the servomotor 103 through a gear train including the pinions 63*b*, 63*e* and the driven gears 63*d*, 63*c*. Therefore, the web pressing member 66*a* on the web pressing unit 66 and the cutter member 65*a* on the cutter unit 65 can be turned synchronously in the opposite directions. As a result, the cutter T on the cutter member 65*a* can precisely and reliably enter the groove D on the web pressing member 66*a* when the cutter T and the groove D are turned to the respective positions for cutting the web W at the end of the winding of the web W on each of the bobbins 33, 43, so that the cutting of the web W can be done precisely.

It is to be noted that the synchronous driving mechanism for the web pressing unit 66 and the cutter unit 65 is configured by the gear train including the pinions 63*b*, 63*e* and the driven gears 63*d*, 63*c*. However, the synchronous driving mechanism is not limited to the gear train and may be constructed by providing the cutter unit 65 and the web pressing unit 66 with respective servomotors which can be synchronously controllable by the controller 110. It is also to be noted that although the shafts 62*a*, 63*a* and the gears 62*a*1, 62*a*2 in the slide head 62 and the gears 63*b*-63*e* in the pivot plate 63 are all illustrated in a skeletal form for brevity purpose, the structures of these components are apparent to those skilled in the art.

Although in the foregoing embodiment, the support bodies 31, 41 of the first and second web support devices 30, 40 are fixed on the bed 20, the support bodies may be independently movable relative to the bed in the front-read direction. By doing so, it becomes possible to advance the support body 31/41 forward in dismounting the bobbin 33/43 from the rotational center member 32/42, so that the dismounting work becomes easy.

Various features and many of the attendant advantages in the foregoing embodiment will be summarized as follows:

According to the feature in the first aspect of the forgoing embodiment, as typically shown in FIGS. 9 to 13, the web pressing member 66*a* operates as cutter receiving member. As means for cutting the web W with the cutter T, it may be conceivable to provide means for holding the web W with a predetermined tension force applied thereto or means for arranging the cutter receiving member 66*a* on the opposite side to the cutter side of the both sides of the web W. The latter means of using the cutter receiving member 66*b* is applied to the present embodiment. By being operated as the cutter receiving member, the web pressing member 66*a* is able to hold the cut end of the web W just cut with the cutter T. Further, the web pressing member 66*a* also operates to press the web W held thereby on the bobbin 33/43 being empty. That is, because of being able to continue holding the cut end of the web W, the web pressing member 66*a* is able to press the cut end of the web W on the empty bobbin 33/43 while keeping the holding state. Therefore, the cut end of the web W is wound by the web pressing member 66*a* on the empty bobbin 33/43. That is, since the cut end of the web W is pressed directly on the empty bobbin 33/43 not by air blow but by the web pressing member 66*a*, it is possible to reliably wind the end portion of the web W on the empty bobbin 33/43. As a result, the web W can be prevented from being folded or loosened at the end portion thereof when wound on the bobbin 33/43.

In a second aspect of the foregoing embodiment, the cutter T and the web pressing member 66*a* are provided movably between the bobbin 33 on one side and the bobbin 43 on the other side. That is, the web W is transferred to come between the two bobbins 33, 43 from outside and is transferred to the bobbin 33/43 on either side to be wound on the bobbin. Thus, where the web W is wound on each of the two bobbins 33, 43 which are rotated in the same direction, the respective webs W wound on the two bobbins 33, 43 agree in inside and outside thereof. Therefore, according to the feature in the second aspect of the foregoing embodiment, as typically shown in FIGS. 15 to 19, the two bobbins 43, 33 are made to be rotatable in the same direction, and in winding the cut end of the web W on the bobbin 43/33 being empty, the web pressing member 66*a* is moved to stand at the side advanced in phase relative to the cutter T. By doing so, the respective webs W wound on the two bobbins 43, 33 are made to agree in inside and outside thereof. Further, by so providing the web pressing member 66*a* as to be able to rock relative to the cutter T, the respective webs W wound on the two bobbins 43, 33 are made to agree in inside and outside thereof as mentioned above even where each of the cutter T and the web pressing member 66*a* is provided by one only. This makes it possible to downsize the web winding apparatus.

According to the feature in a third aspect of the foregoing embodiment, as typically shown in FIGS. 12-14 and 18-20, the cutter T and the web pressing member 66*a* are turned synchronously. This synchronous turns are performed by, for example, the synchronous driving mechanism 63*a*-63*e*, 103-105, 110 (refer to FIG. 22) that turns the web pressing member 66*a* synchronously with the rotation of the bobbin 43/33 being empty and the turn of the cutter T. Thus, it can be realized to shorten the distance from the turn position of the cut end of the web W on the web pressing member 66*a* at which position the web W is cut, to the turn position of the cut end of the web W on the web pressing member 66*a* at which position the cut end of the web W is wound on the empty bobbin 43/33. Accordingly, the cut end of the web W can be prevented from separating from the web pressing member 66*a* before being would on the empty bobbin 43/33. That is, it becomes possible to reliably wind the cut end of the web W on the empty bobbin 43/33.

According to the feature in a fourth aspect of the foregoing embodiment, as typically shown in FIGS. 3, 12-14, since the roller 66*c* is provided on the back side of the web pressing member 66*a*, the turn of the web pressing member 66*a* makes the roller 66*c* take the position on the web W side. This roller 66*c* operates as touch roller that presses the outer peripheral surface of the web W being wound. That is, the outer peripheral surface of the web W is pressed by the roller 66*c* immediately after the web pressing member 66*a* is turned. Accordingly, the winding of the web W on the bobbin 43/33 can be done stably.

According to the feature in a fifth aspect of the foregoing embodiment, as typically shown in FIG. 7, since the common pump P is used for dust suction and for the holding of the cut end of the web W on the web pressing member 66*a*, the web winding apparatus can be downsized. Further, the suction force of the pump P is utilized for dust suction and for the holding of the cut end of the web W on the web pressing member 66*a*, the web pressing member 66*a* can be simplified in construction.

According to the feature in a sixth aspect of the foregoing embodiment, as typically shown in FIG. 7, since the plurality of pump suction holes H2 open at the circular arc convex surface of the web pressing member 66*a*, the cut end of the web W can reliably be held on the circular arc convex surface of the web pressing member 66*a*, so that the cut end of the web W can reliably delivered from the web pressing member 66*a* onto the empty bobbin 43/33.

According to the feature in a seventh aspect of the foregoing embodiment, as typically shown in FIGS. 6, 7 and 10-13, since the web pressing member 66*a* and the cutter member 65*a* have the respective circular arc convex surfaces which are brought to face each other by the turns of the both members 66*a*, 65*a*, the web W can reliably be held therebetween, then be cut and then be delivered onto the empty bobbin 43/33.

Figure 11:
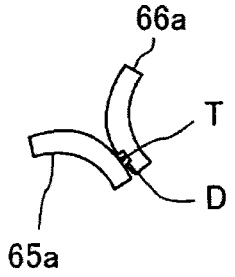
FIG. 11 is an illustration showing in an enlarged scale the cutter member and the web pressing member in the state of FIG. 10.

According to the feature in an eighth aspect of the foregoing embodiment, as typically shown in FIGS. 10-11, the cutter unit 65 with the cutter T and the web pressing unit 66 with the web pressing member 66*a* are supported on the pivot plate 63 to be turnable synchronously, and in cutting the web W when one of the bobbins 33, 43 becomes filled with winding turns of the web W thereon, the synchronous driving mechanism 63*a*-63*e*, 103, 110 synchronously rotates the cutter unit W and the web pressing unit 66 to put the web W to be cut between the circular arc convex surfaces of the cutter unit 65 and the web pressing member 66*a* and then to make the cutter T enter the cutter receiving groove D. Therefore, the synchronous turns of the cutter unit 65 and the web pressing unit 66 can reliably be given by the driving mechanism 63*a*-63*e*, 103, 110, so that the cutting of the web W and the subsequent delivery of the cut end of the web W onto the empty bobbin 33/43 can be performed reliably.

Figure 4:
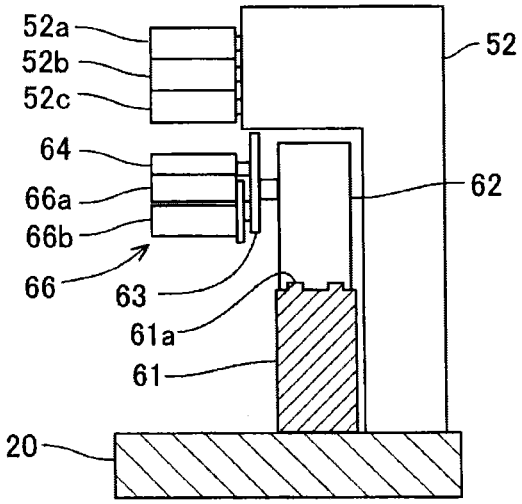
FIG. 4 is a sectional view of the apparatus taken along the line IV-IV in FIG. 3, wherein a bobbin, a peripheral cover and the like located at the deep side in FIG. 4 (the left side in FIG. 3) are omitted from illustration.
Figure 5:
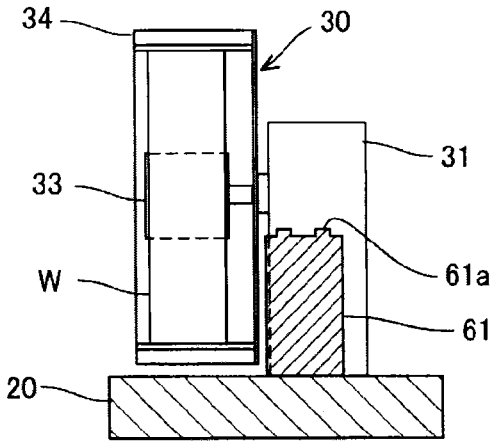
FIG. 5 is a sectional view of the apparatus taken along the line V-V in FIG. 3.

According to the feature in a ninth aspect of the foregoing embodiment, as typically shown in FIGS. 3, 4 and 22, the sliding mechanism 101, 101*a* slides the slide head 62 to bring the pivot plate 63 supporting the cutter unit 65 and the web pressing unit 66 to one of two predetermined positions adjacent to the two bobbins 33, 43 for starting the winding of the web W on one of the bobbins 33, 43 and to retract the slide head 62 away from the one of the bobbins 33, 43 synchronously with an increase in winding turns of the web W on the one of the bobbins 33, 43. Therefore, the distance between the pivot plate 63 serving as web distributor and the bobbin 33/43 on which the web W is being wound can be properly adjusted while the outer peripheral surface of the web W being wound on the bobbin 33/43 is increased in diameter as the winding progresses, so that the winding on the bobbin 33/43 can be done accurately from the beginning to the end in winding.

Obviously, numerous further modifications and variations of the present invention are possible in light of the above teachings. It is therefore to be understood that within the scope of the appended claims, the present invention may be practiced otherwise than as specifically described herein.

What is claimed is:

1. A web winding apparatus comprising:

two bobbins each being able to wind a web thereon;

a cutter provided movably between the bobbin on one side and the bobbin on the other side for cutting the web being transferred;

a web pressing member provided at a position to face the cutter so that the web being transferred is put between the web pressing member and the cutter, and provided movably together with the cutter between the two bobbins, the web pressing member operating as cutter receiving member which presses and cuts the web in cooperation with the cutter, and also operating to press a cut end of the web so cut on the bobbin being empty while holding the cut end of the web, to wind the cut end of the web on the bobbin being empty, wherein the cutter is turnable in the same direction as the rotational direction of the bobbins, and the web pressing member is turnable in an opposite direction to the rotational direction of the bobbins, wherein the web pressing member is turned synchronously with the rotation of the bobbin being empty and the turn of the cutter with the web pressing member located at a predetermined position adjacent to the bobbin being empty so that the web pressing member holds a cut end portion of the web cut with the cutter and then winds the cut end portion of the web on the bobbin being empty; and a roller provided on a back side of the web pressing member and being movable together with the web pressing member to press an outer peripheral surface of the web wound on the bobbin being empty after the web pressing member winds the cut end of the web on the bobbin being empty.

2. The web winding apparatus in claim 1, wherein:

the two bobbins are supported rotatably about respective center axes in the same direction; and the web pressing member is provided to be able to move relative to the cutter so that in winding a cut end portion of the web on the bobbin being empty, the web pressing member is moved to stand on a side that is advanced relative to the cutter in phase in the rotational direction of the bobbin being empty.

3. The web winding apparatus in claim 1, further comprising:

a vacuum pump;

a suction mechanism that draws dust produced at the time of cutting the web, by a suction force of the vacuum pump; and a holding mechanism that holds a cut end of the web on the web pressing member by the suction force of the vacuum pump.

4. The web winding apparatus in claim 3, wherein:

the web pressing member takes a circular arc convex surface to roll on an outer surface of the bobbin being empty of the two bobbins and is formed with a cutter receiving groove for enabling the cutter to enter when cutting the web;

the suction mechanism includes a plurality of vacuum suction holes opening at a bottom of the cutter receiving groove of the web pressing member; and the holding mechanism includes a plurality of vacuum suction holes opening at the circular arc convex surface of the web pressing member.

5. The web winding apparatus in claim 1, wherein the web pressing member has a circular arc convex surface to roll on an outer surface of the bobbin being empty of the two bobbins and is formed with a cutter receiving groove for enabling the cutter to enter when cutting the web, the apparatus further comprising:

a cutter member having a circular arc convex surface to face the circular arc convex surface of the web pressing member at the time of cutting the web, the cutter protruding from the circular arc convex surface of the cutter member to enter the cutter receiving groove of the web pressing member when cutting the web in cooperation with the web pressing member.

6. The web winding apparatus in claim 1, further comprising:

a slide head slidable between the two bobbins;

a pivot plate supported by the slide head pivotably about an axis parallel to the axes of the two bobbins;

a cutter unit supported on the pivot plate to be turnable about an axis parallel to the axes of the two bobbins and having a circular arc convex surface protruding the cutter therefrom; and a web pressing unit supported on the pivot plate to be turnable about an axis parallel to the turn axis of the cutter unit and provided with the web pressing member having a circular arc convex surface that is brought to face the circular arc convex surface of the cutter unit to put the web to be cut between the circular arc convex surfaces, the web pressing member being formed with a cutter receiving groove to able to receive the cutter protruding from the cutter unit;

wherein the web is cut when one of the two bobbins becomes filled with winding turns of the web thereon, and the cutter unit and the web pressing unit are synchronously turned to put the web to be cut between the circular arc convex surfaces of the cutter unit and the web pressing member and then to make the cutter enter the cutter receiving groove.

* * * * *